US010443518B2

(12) United States Patent
Shost

(10) Patent No.: US 10,443,518 B2
(45) Date of Patent: Oct. 15, 2019

(54) OPTIMAL FIRING PATTERNS FOR CYLINDER DEACTIVATION CONTROL WITH LIMITED DEACTIVATION MECHANISMS

(71) Applicant: Mark A Shost, Northville, MI (US)

(72) Inventor: Mark A Shost, Northville, MI (US)

(73) Assignee: FCA US LLC, Auburn Hills, MI (US)

( * ) Notice: Subject to any disclaimer, the term of this patent is extended or adjusted under 35 U.S.C. 154(b) by 173 days.

(21) Appl. No.: 15/655,416

(22) Filed: Jul. 20, 2017

(65) Prior Publication Data

US 2019/0024594 A1 Jan. 24, 2019

(51) Int. Cl.
*F02D 41/00* (2006.01)
*F02D 17/02* (2006.01)

(52) U.S. Cl.
CPC ..... *F02D 41/0087* (2013.01); *F02D 17/02* (2013.01); *F02D 41/0085* (2013.01); *F02D 2200/1002* (2013.01); *F02D 2200/501* (2013.01); *F02D 2250/18* (2013.01); *F02D 2400/02* (2013.01)

(58) Field of Classification Search
CPC .. F02D 41/0087; F02D 41/0085; F02D 17/02; F02D 2200/1002; F02D 2250/18; F02D 2400/02
USPC ..... 123/481
See application file for complete search history.

(56) References Cited

U.S. PATENT DOCUMENTS

| | | | | |
|---|---|---|---|---|
| 4,509,488 | A | 4/1985 | Forster et al. | |
| 7,577,511 | B1 | 8/2009 | Tripathi et al. | |
| 8,464,690 | B2 | 6/2013 | Yuille et al. | |
| 8,880,258 | B2 | 11/2014 | Breton et al. | |
| 8,892,330 | B2 | 11/2014 | Yuille et al. | |
| 9,200,575 | B2 | 12/2015 | Shost | |
| 9,212,610 | B2 | 12/2015 | Chen et al. | |
| 9,239,024 | B2 | 1/2016 | Beikmann | |
| 9,458,778 | B2 | 10/2016 | Rayl et al. | |
| 2013/0092127 | A1* | 4/2013 | Pirjaberi | F02D 41/0087 123/406.23 |
| 2016/0053697 | A1 | 2/2016 | Pirjaberi et al. | |
| 2016/0201586 | A1* | 7/2016 | Serrano | F02D 41/307 701/111 |
| 2017/0218866 | A1* | 8/2017 | Shost | F02D 41/0087 |
| 2017/0370308 | A1* | 12/2017 | Hashemi | F02D 41/0087 |

* cited by examiner

*Primary Examiner* — Mahmoud Gimie
(74) *Attorney, Agent, or Firm* — Ralph E. Smith

(57) ABSTRACT

An engine system for a vehicle includes an engine comprising X cylinders (X≥4) and Y deactivation mechanisms (X/2<Y<X), each of the Y deactivation mechanisms being configured to deactivate a different one of the X cylinders and wherein the Y deactivation mechanisms are arranged an optimal Y of the X cylinders for a defined firing order of the X cylinders. The engine system further includes a controller configured to: determine a torque request for the engine, determine a set of potential firing fractions of the engine, each firing fraction representing a particular Z of the X cylinders being deactivated (0<Z≤Y) based on the torque request, determine an optimal firing fraction of the set of potential firing fractions, based on the optimal firing fraction, command a corresponding Z of the Y deactivation mechanisms to deactivate the determined Z of the X cylinders, and command firing of a remainder the X cylinders.

19 Claims, 3 Drawing Sheets

OPTIMAL FIRING PATTERNS FOR CYLINDER DEACTIVATION CONTROL WITH LIMITED DEACTIVATION MECHANISMS

FIELD

The present application generally relates to cylinder deactivation techniques and, more particularly, to optimal firing patterns for cylinder deactivation control with limited deactivation mechanisms.

BACKGROUND

Conventional load-based control of engines involves controlling a throttle valve upstream from an intake manifold. During low-load operation, the throttle valve closes to maintain engine speed, which results in decreased intake manifold absolute pressure (MAP). Operating the engine with this decreased MAP, however, results in a penalty where the working pistons are creating vacuum during their intake strokes. This is also known as "pumping work" or "pumping losses," which decreases fuel economy. Accordingly, while such engines work well for their intended purpose, there remains a need for improvement in the relevant art.

SUMMARY

According to one example aspect of the invention, an engine system for a vehicle is presented. In one exemplary implementation, the engine system comprises an engine comprising X cylinders configured to combust a mixture of an air and a fuel to generate drive torque, where X is an integer greater than or equal to four, and Y deactivation mechanisms, each of the Y deactivation mechanisms being configured to deactivate a different one of the X cylinders, wherein Y is an integer less than X and greater than (X/2) and wherein the Y deactivation mechanisms are arranged an optimal Y of the X cylinders for a defined firing order of the X cylinders. In this exemplary implementation, the engine system further comprises a controller configured to: determine a torque request for the engine, determine a set of potential firing fractions of the engine, each firing fraction representing a particular Z of the X cylinders being deactivated, where Z is an integer greater than or equal to zero and less than or equal to Y, based on the torque request, determine an optimal firing fraction of the set of potential firing fractions, based on the optimal firing fraction, command a corresponding Z of the Y deactivation mechanisms to deactivate the determined Z of the X cylinders, and command firing of a remainder the X cylinders.

In some implementations, the engine further comprises an intake manifold that houses the air, and the controller is configured to determine the optimal firing fraction by determining which of the set of potential firing fractions will maintain a pressure of the air in the intake manifold at or near barometric pressure. In some implementations, the controller is configured to determine which Z of the X cylinders to deactivate by: determining a torque achievable by a remaining (X−Z) of the X cylinders, and determining whether (i) the achievable torque is greater than or equal to the torque request and (ii) operating the engine with the remaining (X−Z) of the X cylinders will satisfy noise/vibration/harshness (NVH) thresholds. In some implementations, when the achievable torque is less than the torque request or operating the engine with the remaining (X−Z) of the X cylinders will not satisfy the NVH thresholds, the controller determines to deactivate less than Z of the X cylinders. In some implementations, the controller determines (Z−A) of the X cylinders to deactivate such that (i) the (Z−A) of the X cylinders have an achievable torque greater than or equal to the torque request and (ii) operating the engine with the (Z−A) of the X cylinders will satisfy the NVH thresholds, where A is an integer greater than zero. In some implementations, A equals one. In some implementations: the engine is a V engine comprising first and second cylinder banks, each cylinder bank comprising a distinct half of the X cylinders, and the firing order of the X cylinders defines a sequence of the X cylinders.

In some implementations: X equals 6, the first cylinder bank comprises cylinders 1, 3, and 5 from the firing order, the second cylinder bank comprises cylinders 2, 4, and 6 from the firing order, Y equals 5, and cylinders 1-5 from the firing order have the 5 deactivation mechanisms associated therewith. In some implementations, the controller is configured to operate the engine in 7 different modes, ranging from only 1 of the 6 cylinders firing (1/6) to all of the 6 cylinders firing (6/6), with modes 2/6, 3/6, 4/6, and 5/6 therebetween. In some implementations, the controller is configured to command firing according to the 2/6 mode when the torque request is below a threshold and the vehicle is operating below a low speed threshold. In some implementations, the low speed threshold corresponds to neighborhood driving and is approximately 25 miles per hour. In some implementations, the controller is configured to command firing according to one of the 4/6 and 5/6 modes when the torque request is below a threshold and the vehicle is operating above a high speed threshold. In some implementations, the high speed threshold corresponds to highway driving and is approximately 70 miles per hour.

In some implementations: X equals 8, the first cylinder bank comprises cylinders 1, 4, 6, and 7 from the firing order, the second cylinder bank comprises cylinders 2, 3, 5, and 8 from the firing order, Y equals 6, and cylinders 1, 2, 3, 5, 6, and 7 from the firing order have the deactivation mechanisms associated therewith. In some implementations, the controller is configured to operate the engine 7 different modes, ranging from only 2 of the 8 cylinders firing (2/8) to all 8 of the cylinders firing (8/8), with modes 3/8, 4/8, 5/8, 6/8, and 7/8 therebetween. In some implementations, the controller is configured to command firing according to the 2/8 mode when the torque request is below a threshold and the vehicle is operating below a low speed threshold. In some implementations, the low speed threshold corresponds to neighborhood driving and is approximately 25 miles per hour. In some implementations, the controller is configured to command firing according to one of the 5/8, 6/8, and 7/8 modes when the torque request is below a threshold and the vehicle is operating above a high speed threshold. In some implementations, the high speed threshold corresponds to highway driving and is approximately 70 miles per hour.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

One method for mitigating or eliminating pumping losses is cylinder deactivation. This is particularly useful for engines comprising larger numbers of cylinders (6, 8, etc.), which are often arranged in two cylinder banks arranged at an angle with respect to each other, also known as a V-configuration. Cylinder deactivation involves temporarily deactivating some of the cylinders (e.g., by closing their intake/exhaust valves using respective deactivation mechanisms) during low or light load operation. For a V8 engine, for example, there may be four deactivation mechanisms and thus the engine is configured to operate in either a four-cylinder (V4) mode or an eight-cylinder (V8) mode.

In this example configuration, however, the V4 mode is typically incapable of achieving the engine's torque request across a wide range of operating conditions, e.g., above 45 miles per hour. Thus, the fuel economy benefit from this V4/V8 cylinder deactivation system is far from optimal. Implementing deactivation mechanism(s) on each of the 8 cylinders would provide for dynamic cylinder deactivation control. Such a configuration, however, would be costly due to the requirement of 8 deactivation mechanisms and it would be very complex to determine the optimal deactivation schemes. Accordingly, there remains a need for an improvement in the art of cylinder deactivation systems.

Figure 1:
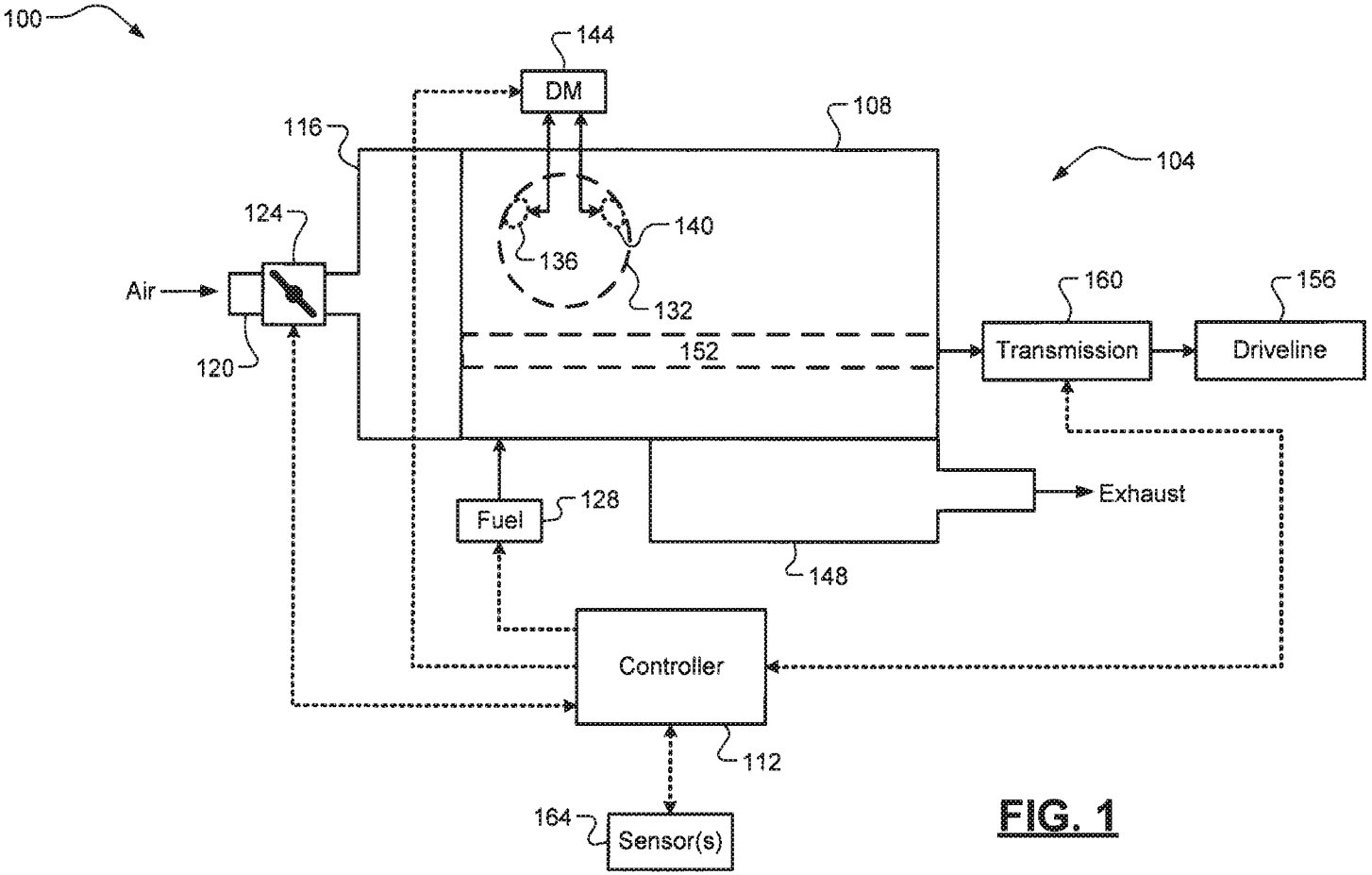
FIG. 1 depicts an example vehicle comprising an engine system and a V-engine according to the principles of the present disclosure.

Referring now to FIG. 1, a vehicle 100 comprising an engine system 104 is illustrated. The engine system 104 comprises an engine 108 that combusts an air/fuel mixture to generate drive torque and a controller 112 that controls operation of the engine 108. The engine 108 draws air into an intake manifold 116 through an induction system 120 that is regulated by a throttle valve 124. The air in the intake manifold is combined with fuel from fuel injectors 128 and the air/fuel mixture is combusted within a plurality of cylinders 132. In one exemplary implementation, the engine 108 is a V-engine having its X cylinders evenly distributed between two distinct cylinder banks. Each cylinder 132 comprises a respective intake and exhaust valve 136, 140 that are selectively deactivated by a respective deactivation mechanism 144.

A non-limiting example of the deactivation mechanisms 144 is one or more solenoids (e.g., one solenoid for both valves 136, 140 or one solenoid per valve 136, 140). By closing the intake/exhaust valves 136, 140 with the deactivation mechanisms 144 (e.g., as well as disabling fueling), the air/fuel supply to the cylinders 132 is disabled. While not shown, each cylinder 132 may also have a respective spark plug for igniting the air/fuel mixture therein. Exhaust gas resulting from combustion is expelled via the exhaust valves 140 and treated by an exhaust system 148 before being released into the atmosphere. The combustion of the air/fuel mixture within the cylinders 132 drives respective pistons (not shown), which rotatably turn a crankshaft 152.

The drive torque is transferred from the crankshaft 152 to a driveline 156 via a transmission 160. One or more sensors 164 are utilized by the controller 112 to monitor operating parameters of the vehicle 100, such as, but not limited to, accelerator pedal position, throttle valve position, intake mass air flow (MAF), intake MAP, intake/exhaust valve positions, as well as other speeds and temperatures (crankshaft speed, transmission output shaft or vehicle speed, air/exhaust gas temperatures, etc.). The controller 112 is also configured to perform at least a portion cylinder deactivation techniques as described in greater detail later herein. It will be appreciated, however, that at least a portion of the techniques (e.g., optimizing the placement of the Y DMs) could be performed by another computing system prior to vehicle assembly.

Figure 2A:
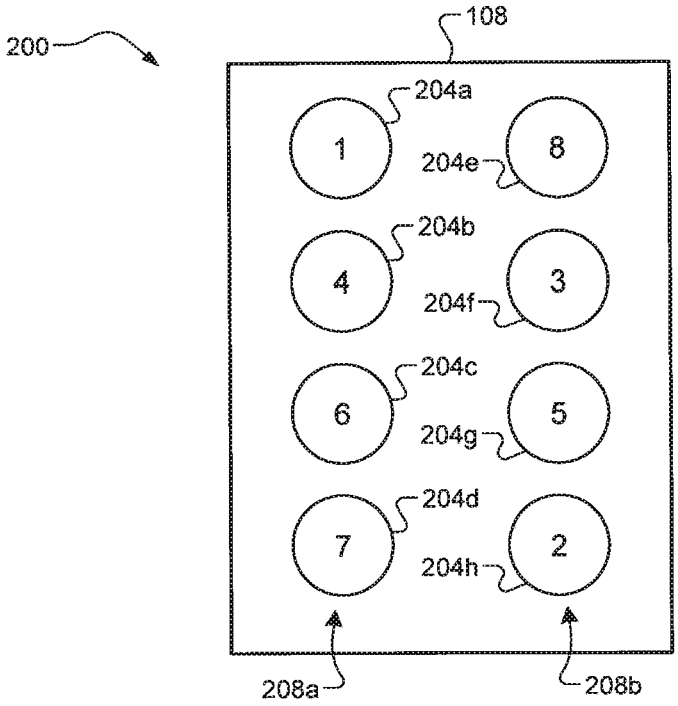
FIGS. 2A-2B depict example firing orders for six and eight cylinder configurations of the V-engine according to the principles of the present disclosure.
Figure 2B:
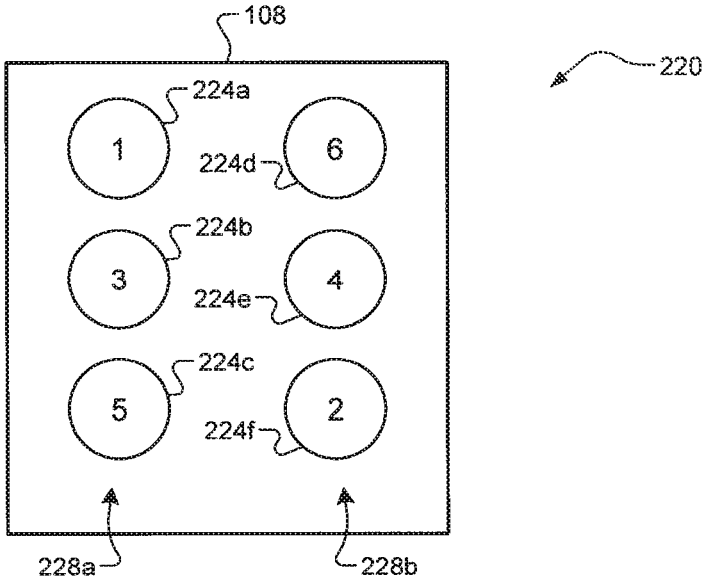

Referring now to FIGS. 2A-2B, two example configurations 220, 220 for the engine 108 are illustrated. FIG. 2A illustrates a V-engine 200 configuration comprising eight cylinders 204*a* . . . 204*h* arranged in first and second cylinder banks 208*a*, 208*b*. A sequential firing order for this particular V-engine configuration 200 is also illustrated (1, 2, . . . , 8), which does not correspond to a conventional numbering or labeling of the cylinders. FIG. 2B illustrates another V-engine 220 configuration comprising six cylinders 224*a* . . . 224*f* arranged in first and second cylinder banks 228*a*, 228*b*. A sequential firing order for this particular V-engine configuration 220 is also illustrated (1, 2, . . . , 6). As shown, an optimal firing order often alternates between cylinder banks 208, 228 for balancing, e.g., to mitigate noise/vibration/harshness (NVH).

According to one aspect of the invention, the cylinder deactivation mechanisms 144 are implemented for less than all of the cylinders and in optimal positions for each configuration 200, 220 as discussed in greater detail below. In doing so, component and implementation costs are decreased while achieving performance (e.g., fuel economy) at or near the level achievable using cylinder activation mechanisms for all of the cylinders. In order to generalize these techniques for any suitable V-engine, the integer variables X, Y, and Z are also utilized herein to describe the number of cylinders in the engine (X), the number of cylinders having deactivation mechanisms associated therewith (Y, where $Y<X$), and the number of cylinders to be deactivated (Z, where $0\leq Z\leq Y$) for a particular torque request (e.g., based on accelerator pedal position).

For purposes of this disclosure, we define a number of patterns as:

$$\text{Number of Patterns}=2^{X},$$

where X is the number of cylinders as previously mentioned. For the six cylinder configuration 220, for example, there are $2^6$ or 64 unique firing patterns. The average number of fired cylinders per engine cycle can be normalized by dividing the average number of by the cylinder count, thereby yielding a ratio of fired cylinders between 0 and 1, inclusive.

The sequences of fires and skips may also be referred to as a firing fraction, where the numerator represents the number of cylinders fired and the denominator represents the number of firing opportunities:

$$\text{Firing Fraction(FF)}=(\text{Fires}/\textit{Ops}),$$

where Fires represents the number of firings ($0\leq \text{Fires}\leq \text{Ops}$, $0\leq \text{FF}\leq 1$), Ops represents the number of firing opportunities, and Skips equals the difference between Ops and Fires (Skips=Ops−Fires).

A binary value of 0 (skip) or 1 (fire) could also be assigned to each cylinder for a particular firing order, e.g., no fires for a six cylinder configuration could be represented as 000000. The firing patterns can be generalized for any particular firing fraction (constrained with the denominator equal to the cylinder count) by applying the binomial theorem to find the number of possible patterns as follows:

Number of Patterns=($X$!/(Fires!×Skips!))=($X$!/(Fires!×($X$-Fires)!)).

For the example six cylinder configuration 220 of FIG. 2B, there are (6!/(2!×(6−2)!)), or 15 possible firing patterns, when there are deactivation mechanisms 144 associated with two cylinders (Y=2), or a firing fraction FF equal to 1/3. The various firing patterns are illustrated in Table 1 below:

TABLE 1

| Decimal Value | Binary Value | Cylinder Number 1 | 2 | 3 | 4 | 5 | 6 |
|---|---|---|---|---|---|---|---|
| 3 | 000011 | 0 | 0 | 0 | 0 | 1 | 1 |
| 5 | 000101 | 0 | 0 | 0 | 1 | 0 | 1 |
| 6 | 000110 | 0 | 0 | 0 | 1 | 1 | 0 |
| 9 | 001001 | 0 | 0 | 1 | 0 | 0 | 1 |
| 10 | 001010 | 0 | 0 | 1 | 0 | 1 | 0 |
| 12 | 001100 | 0 | 0 | 1 | 1 | 0 | 0 |
| 17 | 010001 | 0 | 1 | 0 | 0 | 0 | 1 |
| 18 | 010010 | 0 | 1 | 0 | 0 | 1 | 0 |
| 20 | 010100 | 0 | 1 | 0 | 1 | 0 | 0 |
| 24 | 011000 | 0 | 1 | 1 | 0 | 0 | 0 |
| 33 | 100001 | 1 | 0 | 0 | 0 | 0 | 1 |
| 34 | 100010 | 1 | 0 | 0 | 0 | 1 | 0 |
| 36 | 100100 | 1 | 0 | 0 | 1 | 0 | 0 |
| 40 | 101000 | 1 | 0 | 1 | 0 | 0 | 0 |
| 48 | 110000 | 1 | 1 | 0 | 0 | 0 | 0 |

As can be seen, some of the possible firing patterns do not meet the most equal spacing criteria (e.g., for bank-to-bank balancing and mitigated NVH). Three of the patterns are highlighted, which represent the patterns that meet these criteria, which may also be described as NVH thresholds. These three particular firing patterns also represent a phase shift of one cylinder (pattern 36 begins with cylinder 1 firing, pattern 18 begins with cylinder 2 firing, and pattern 9 begins with cylinder 4 firing), with two skips thereafter for each pattern.

The above can be evaluated mathematically (e.g., by controller 112) as follows. By normalizing the patterns for the number of cylinders X:

$N$Fires=Fires*($X/Ops$), $N$Skips=$X$−$N$Fires, and

Skips Floor≤Skips≤Skips Ceiling, where Skips represents the number of consecutive skips between fires. Utilizing the above:

Skips Floor=Floor($N$Skips/$N$Fires) and

Skips Ceiling=Ceiling($N$Skips/$N$Fires), where 1≤$N$Fires≤$X$,

Skips Floor=$X$−1,Skips Ceiling=$X$, where 0<$N$Fires<1, and

Skips Floor=Skips Ceiling=$X$, where $N$Fires=0.

Similarly, for fires:

Fires Floor≤Fires≤Fires Ceiling, where Fires represents the number of consecutive fires between skips, Fires Floor=Floor($N$Fires/$N$Skips) and Fires Ceiling=Ceiling($N$Fires/$N$Skips), where 0<$N$Fires<$X$−1, Fires Floor=$X$−1 and Fires Ceiling=$X$, where $X$−1<$N$Fires<$X$, and Fires Floor=Fires Ceiling=$X$, where $N$Fires=$X$.

The Floor function rounds the fractions down to the nearest multiple of significance, which in this case is the nearest integer value. The Ceiling function similarly rounds the fractions up to the nearest integer values. Applying these functions to the FF=1/3 example discussed above, Skips Floor=Skips Ceiling=2, Fires Floor=0, and Fires Ceiling=1, the only three of the 15 patterns that meet the conditions are patterns 9, 18, and 36. The number of skips between firing events can also vary by no more than one to remain the most equal spacing, and thus at any given firing fraction FF there can be no more than X+1 patterns available.

Therefore, using these equations, the most equally spaced (MES) patterns for any firing fraction FF can be determined. For the example previously discussed, the simplified firing fraction is ⅓ (from 2/6). The number of MES patterns can be described as the minimum of the simplified denominator and X+1, where the simplified denominator is:

Simplified Denominator=Denominator/$GCD$(Denominator,Numerator),

Number of MES Patterns=Minimum(Simplified Denominator,$X$+1).

For the 2/6 example, the number of MES patterns=minimum (6/GCD(6,2), 6+1) or the minimum(3,7), which equals 3.

The above can be utilized to calculate all the possible MES patterns for a particular engine that are available at specific firing fractions. The hardware configuration, however, also affects which Z of the X cylinders are deactivatable. For the example six cylinder configuration 220 discussed herein, the optimal cylinder deactivation mechanism positioning, firing fractions, and MES patterns are shown in Table 2 below:

TABLE 2

| Y | DM Position(s) | # of FF | FF | # of MES Patterns |
|---|---|---|---|---|
| 1 | 1 | 2 | 1, 5/6 | 2 |
| 2 | 1 (2, 3, 5, or 6) | 2 | 1, 5/6 | 3 or 4 |
| 2 | 1, 4 | 3 | 1, 5/6, 2/3 | 4 |
| 3 | 1, 3, 5 | 4 | 1, 5/6, 3/4, 1/2 | 7 |
| 4 | 1, 3, 4, 5 | 5 | 1, 5/6, 3/4, 2/3, 1/2 | 10 |
| 5 | 1, 2, 3, 4, 5 | 7 | 1, 5/6, 3/4, 2/3, 1/2, 1/3, 1/6 | 18 |
| 6 | 1, 2, 3, 4, 5, 6 | 19 | 1, 6/7, 5/6, 4/5, 3/4, 5/7, 2/3, 3/5, 4/7, 1/2, 3/7, 2/5, 1/3, 2/7, 1/4, 1/5, 1/6, 1/7, 0 | 36 |

The optimal configurations represent those having the greatest number of firing fractions FF and the largest spread of operating fractions, thereby allowing for the most broad reduction of pumping losses and the smallest fraction step size and allowing for smoother transitions between operating points. As can be seen, moving from 3 deactivation mechanisms (DMs) to 4 DMs adds the 2/3 firing fraction FF operating point, which could be desirable for low load, high vehicle speed scenarios (e.g., highway driving at approximately 70 miles per hour, or mph). Even better, however, is 5 DMs, which adds the 1/3 and 1/6 firing fraction FF operating points, which are desirable for low load, low vehicle speed scenarios (e.g., neighborhood driving at approximately 25 mph). The 5 DM solution is also much easier to implement as there are only 7 firing fraction FF operating points compared to 19 for the 6 DM solution. Referring to the six cylinder configuration 220 of FIG. 2B, the Y=5 DMs would be implemented on all but cylinder 224*d* (e.g., sixth or last in the firing order).

The above can be extended to the eight cylinder configuration 200 of FIG. 2A. The relevant data, including the number of firing fractions FF and the # of MES patterns are summarized in Table 3 below. As shown, moving from 4 to 5 DMs adds the 5/8 firing fraction FF operating point, which could be suitable for low load, high vehicle speed scenarios (e.g., highway driving at ~70 mph). Even better, however, is 6 DMs, which adds the 1/4 firing fraction FF operating point, as this is better suited for low load, low vehicle speed scenarios (e.g., neighborhood driving at ~25 mph).

TABLE 3

| Y | DM Position(s) | # of FF | FF | # of MES Patterns |
|---|---|---|---|---|
| 1 | 1 | 2 | 1, 7/8 | 2 |
| 2 | 1 (2, 3, 4, 6, 7, or 8) | 2 | 1, 7/8 | 3 or 4 |
| 2 | 1, 5 | 3 | 1, 7/8, 3/4 | 4 |
| 3 | 1, 3, 6 | 3 | 1, 7/8, 5/8 | 6 or 7 |
| 4 | 1, 3, 5, 7 | 5 | 1, 7/8, 5/6, 3/4, 1/2 | 10 |
| 5 | 1, 2, 3, 5, 7 | 6 | 1, 7/8, 5/6, 3/4, 5/8, 1/2 | 13, 14, 15, or 17 |
| 6 | 1, 2, 3, 5, 6, 7 | 7 | 1, 7/8, 5/6, 3/4, 5/8, 1/2, 1/4 | 22 or 23 |
| 7 | 1, 2, 3, 4, 5, 6, 7 | 9 | 1, 7/8, 5/6, 3/4, 5/8, 1/2, 3/8, 1/4, 1/8 | 38 |
| 8 | 1, 2, 3, 4, 5, 6, 7, 8 | 29 | 1, 8/9, 7/8, 6/7, 5/6, 4/5, 7/9, 3/4, 5/7, 2/3, 5/8, 3/5, 4/7, 5/9, 1/2, 4/9, 3/7, 2/5, 3/8, 1/3, 2/7, 1/4, 2/9, 1/5, 1/6, 1/7, 1/8, 1/9, 0 | 76 |

As can be seen, moving from 6 DMs to 7 DMs only adds the 1/8 and 3/8 firing fraction FF operating points, which may not provide much if any benefit over the 1/4 firing fraction FF operating point. The 6 DM solution is also much easier to implement, as there are only 7 firing fraction FF operating points compared to 29 for the 8 DM solution. Referring to the eight cylinder configuration 200 of FIG. 2A, the Y=6 DMs would be implemented on all but cylinders 204*b* and 204*e* (e.g., fourth and eight in the firing order).

Figure 3:
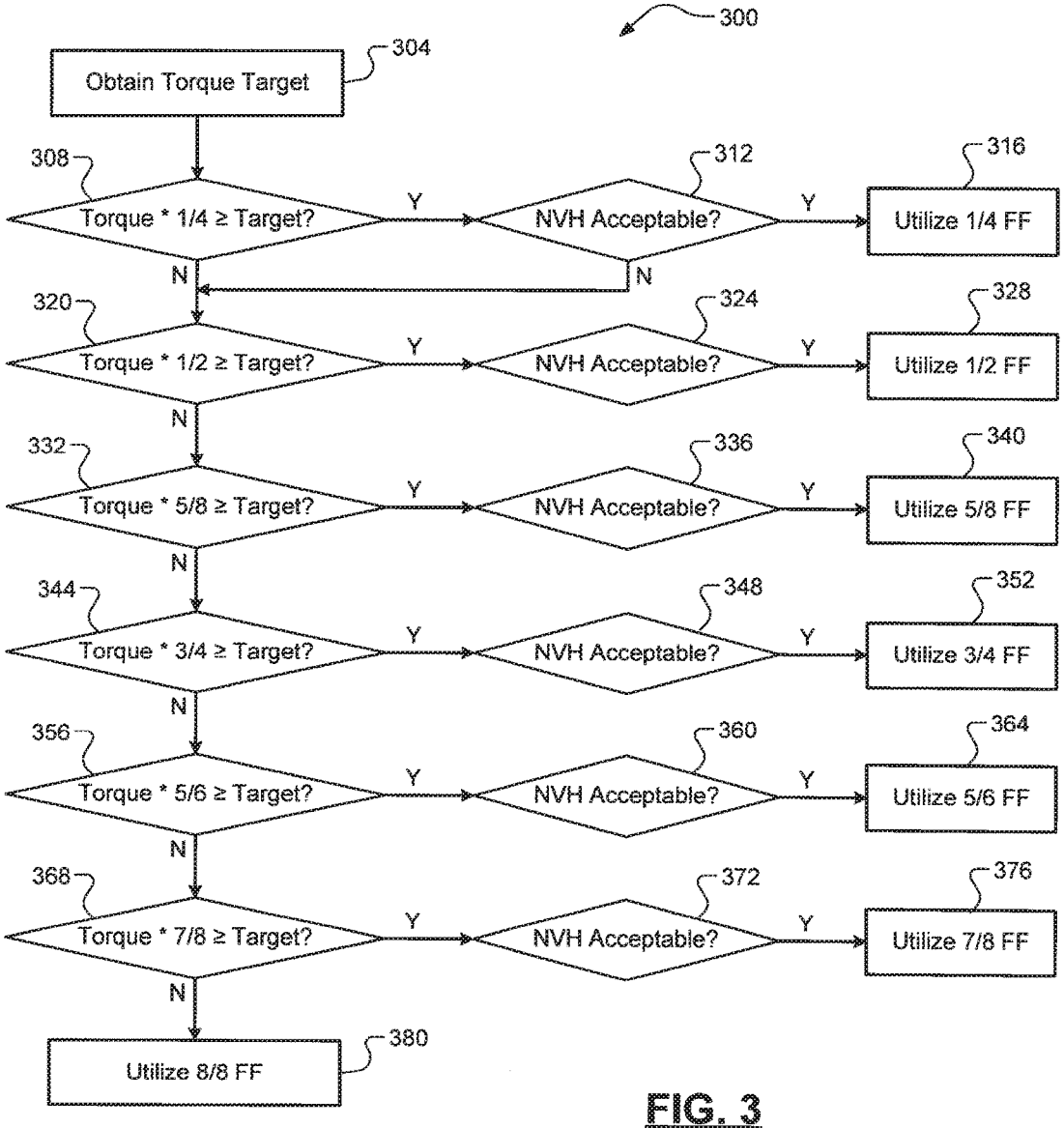
FIG. 3 depicts a flow diagram of an example method of cylinder deactivation control according to the principles of the present disclosure.

Referring now to FIG. 3, a flow diagram of an example method 300 of cylinder deactivation control is illustrated. While illustrated for the 6 DM solution for the eight cylinder engine configuration 200, it will be appreciated that the method 300 could be modified for any of the implementations discussed herein. At 304, the controller 304 determines a torque target for the engine 108, which could be based on a torque request as interpreted from an accelerator pedal position. At 308, the controller 112 determines whether the torque achievable by the engine 108 times a corresponding fraction (¼) exceeds the torque target. This fraction, for example, corresponds to the firing fraction FF operating point currently being analyzed. If true, the controller 112 determines whether such operation would satisfy NVH thresholds at 312. For example, the engine 108 may be able to achieve the torque target at a particular firing fraction FF operating point, but doing so could result in excess vibration that would not satisfy the NVH thresholds. If these NVH thresholds are satisfied, however, the controller 112 proceeds to 316 and utilizes the particular firing fraction FF operating point (¼). If the NVH thresholds are not satisfied, however, the method 300 proceeds to 320 where the next firing fraction FF operating point (½) is analyzed and so on and so forth at steps 320-380. If no partial firing configuration is able to satisfy the torque and NVH thresholds, the controller 112 can operate the engine 108 using all X cylinders at 284.

As previously discussed herein, some of the benefits of these techniques include the controller 112 being able to determine the optimal firing fractions for specific hardware configurations. Implementing a deactivation mechanism on every cylinder is both costly from a hardware standpoint but also from a complexity and calibration standpoint. That is, the controller 112 would be required to run through many more possible firing fractions in order to determine which operating point to utilize for a particular torque request. This is expensive from both a time and computational resource perspective. Thus, the technical effect of these systems and methods is decreased costs through the use of deactivation mechanisms for less than all of the cylinders, as well as the optimal positioning of and quantity of deactivation mechanisms, which unexpectedly achieves the same or approximately the same performance (e.g., fuel economy) compared to deactivation mechanisms for every cylinder.

It will be appreciated that the term "controller" as used herein refers to any suitable control device or set of multiple control devices that is/are configured to perform at least a portion of the techniques of the present disclosure. Non-limiting examples include an application-specific integrated circuit (ASIC), one or more processors and a non-transitory memory having instructions stored thereon that, when executed by the one or more processors, cause the controller to perform a set of operations corresponding to at least a portion of the techniques of the present disclosure. The one or more processors could be either a single processor or two or more processors operating in a parallel or distributed architecture. While the controller 112 is also described herein as performing at least a portion of the techniques, it will be appreciated that at least some of these activities could be performed by another system during design stages prior to vehicle assembly (e.g., the determination of the optimal hardware configuration).

It should be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above.

What is claimed is:

1. An engine system for a vehicle, the engine system comprising:

an engine comprising:

X cylinders configured to combust a mixture of an air and a fuel to generate drive torque, where X is an integer greater than or equal to four; and Y deactivation mechanisms, each of the Y deactivation mechanisms being configured to deactivate a different one of the X cylinders, wherein Y is an integer less than X and greater than (X/2), and wherein the Y deactivation mechanisms are arranged in an optimal Y of the X cylinders for a defined firing order of the X cylinders; and a controller configured to:

determine a torque request for the engine;

determine a set of potential firing fractions of the engine, each firing fraction representing a particular Z of the X cylinders being deactivated, where Z is an integer greater than or equal to zero and less than or equal to Y;

based on the torque request, determine an optimal firing fraction of the set of potential firing fractions;

based on the optimal firing fraction, command a corresponding Z of the Y deactivation mechanisms to deactivate the determined Z of the X cylinders; and command firing of a remainder the X cylinders.

2. The engine system of claim 1, wherein the engine further comprises an intake manifold that houses the air, and wherein the controller is configured to determine the optimal firing fraction by determining which of the set of potential firing fractions will maintain a pressure of the air in the intake manifold at or near barometric pressure.

3. The engine system of claim 1, wherein the controller is configured to determine the optimal firing fraction by:

determining a torque achievable by a remaining (X−Z) of the X cylinders; and determining whether (i) the achievable torque is greater than or equal to the torque request and (ii) operating the engine with the remaining (X−Z) of the X cylinders will satisfy noise/vibration/harshness (NVH) thresholds.

4. The engine system of claim 3, wherein when the achievable torque is less than the torque request or operating the engine with the remaining (X−Z) of the X cylinders will not satisfy the NVH thresholds, the controller determines to deactivate less than Z of the X cylinders.

5. The engine system of claim 4, wherein the controller determines (Z−A) of the X cylinders to deactivate such that (i) the (Z−A) of the X cylinders have an achievable torque greater than or equal to the torque request and (ii) operating the engine with the (Z−A) of the X cylinders will satisfy the NVH thresholds, where A is an integer greater than zero.

6. The engine system of claim 5, wherein A equals one.

7. The engine system of claim 1, wherein:

the engine is a V engine comprising first and second cylinder banks, each cylinder bank comprising a distinct half of the X cylinders; and the firing order of the X cylinders defines a sequence of the X cylinders.

8. The engine system of claim 7, wherein:

X equals 6;

the first cylinder bank comprises cylinders 1, 3, and 5 from the firing order;

the second cylinder bank comprises cylinders 2, 4, and 6 from the firing order;

Y equals 5; and cylinders 1-5 from the firing order have the 5 deactivation mechanisms associated therewith.

9. The engine system of claim 8, wherein the controller is configured to operate the engine in 7 different modes, ranging from only 1 of the 6 cylinders firing (1/6) to all of the 6 cylinders firing (6/6), with modes 2/6, 3/6, 4/6, and 5/6 therebetween.

10. The engine system of claim 9, wherein the controller is configured to command firing according to the 2/6 mode when the torque request is below a threshold and the vehicle is operating below a low speed threshold.

11. The engine system of claim 10, wherein the low speed threshold corresponds to neighborhood driving and is approximately 25 miles per hour.

12. The engine system of claim 9, wherein the controller is configured to command firing according to one of the 4/6 and 5/6 modes when the torque request is below a threshold and the vehicle is operating above a high speed threshold.

13. The engine system of claim 11, wherein the high speed threshold corresponds to highway driving and is approximately 70 miles per hour.

14. The engine system of claim 7, wherein:

X equals 8;

the first cylinder bank comprises cylinders 1, 4, 6, and 7 from the firing order;

the second cylinder bank comprises cylinders 2, 3, 5, and 8 from the firing order;

Y equals 6; and cylinders 1, 2, 3, 5, 6, and 7 from the firing order have the deactivation mechanisms associated therewith.

15. The engine system of claim 14, wherein the controller is configured to operate the engine 7 different modes, ranging from only 2 of the 8 cylinders firing (2/8) to all 8 of the cylinders firing (8/8), with modes 3/8, 4/8, 5/8, 6/8, and 7/8 therebetween.

16. The engine system of claim 15, wherein the controller is configured to command firing according to the 2/8 mode when the torque request is below a threshold and the vehicle is operating below a low speed threshold.

17. The engine system of claim 16, wherein the low speed threshold corresponds to neighborhood driving and is approximately 25 miles per hour.

18. The engine system of claim 15, wherein the controller is configured to command firing according to one of the 5/8, 6/8, and 7/8 modes when the torque request is below a threshold and the vehicle is operating above a high speed threshold.

19. The engine system of claim 18, wherein the high speed threshold corresponds to highway driving and is approximately 70 miles per hour.

* * * * *